US011905678B2

(12) United States Patent
Jonsson

(10) Patent No.: US 11,905,678 B2
(45) Date of Patent: Feb. 20, 2024

(54) CONTROL SYSTEMS FOR AN EXCAVATOR AND METHODS FOR CONTROLLING AN EXCAVATOR WITH A MOVABLE EXCAVATOR THUMB AND AN AUXILIARY TOOL HOLD BY AN TILTROTATOR

(71) Applicant: ROTOTILT GROUP AB, Vindeln (SE)

(72) Inventor: Anders Jonsson, Vindeln (SE)

(73) Assignee: ROTOTILT GROUP AB, Vindeln (SE)

( * ) Notice: Subject to any disclaimer, the term of this patent is extended or adjusted under 35 U.S.C. 154(b) by 1160 days.

(21) Appl. No.: 16/606,566

(22) PCT Filed: Apr. 13, 2018

(86) PCT No.: PCT/EP2018/059513
§ 371 (c)(1),
(2) Date: Oct. 18, 2019

(87) PCT Pub. No.: WO2018/192850
PCT Pub. Date: Oct. 25, 2018

(65) Prior Publication Data

US 2021/0095441 A1 Apr. 1, 2021

(30) Foreign Application Priority Data

Apr. 19, 2017 (SE) ..... 1750458-0

(51) Int. Cl.
*E02F 3/32* (2006.01)
*E02F 9/20* (2006.01)
(Continued)

(52) U.S. Cl.
CPC ..... *E02F 9/2033* (2013.01); *E02F 3/3681* (2013.01); *E02F 3/4135* (2013.01);
(Continued)

(58) Field of Classification Search
CPC ..... E02F 9/2033; E02F 3/3681; E02F 3/4135; E02F 3/435; E02F 9/2004; E02F 9/265;
(Continued)

(56) References Cited

U.S. PATENT DOCUMENTS 2,812,082 A * 11/1957 Meldahl ..... E02F 3/34 414/703
2,812,083 A * 11/1957 Meldahl ..... E02F 3/3417 414/703

(Continued)

FOREIGN PATENT DOCUMENTS

| | | | |
|---|---|---|---|
| CA | 2619948 | A1 | 9/2009 |
| DE | 102014218652 | A1 | 3/2016 |
| KR | 20130059725 | A | 6/2013 |

OTHER PUBLICATIONS

Swedish Search Report in corresponding Swedish Application No. 1750458-0 dated Dec. 13, 2017 (2 pages).

(Continued)

*Primary Examiner* — Edwin J Toledo-Duran
(74) *Attorney, Agent, or Firm* — Jeffri A. Kaminski; Venable LLP

(57) ABSTRACT

A control system for an excavator, the excavator comprising a movable arm, a movable excavator thumb and a tiltrotator attached to the arm, the tiltrotator being arranged to hold an auxiliary tool which is rotatable and/or tiltable by means of the tiltrotator. The control system is arranged to control the tiltrotator to rotate and/or tilt the auxiliary tool between a plurality of first positions and at least one second position. The excavator thumb is movable between at least one rest position and a plurality of work positions. The auxiliary tool is arranged to cooperate with the excavator thumb when the auxiliary tool is positioned in any of the at least one second position and when the excavator thumb is positioned in any of the plurality of work positions. The control system
(Continued)

comprises a first blocker arranged to block the movement of the excavator thumb when the auxiliary tool is positioned in any of the plurality of first positions.

15 Claims, 7 Drawing Sheets

(51) Int. Cl.
*E02F 3/36* (2006.01)
*E02F 3/413* (2006.01)
*E02F 3/43* (2006.01)
*E02F 9/26* (2006.01)

(52) U.S. Cl.
CPC ..... *E02F 3/435* (2013.01); *E02F 9/2004* (2013.01); *E02F 9/265* (2013.01)

(58) Field of Classification Search
CPC ..... E02F 3/404; E02F 3/437; E02F 9/2221; E02F 3/425; E02F 3/32; E02F 9/2267
See application file for complete search history.

(56) References Cited

U.S. PATENT DOCUMENTS 3,070,246 A * 12/1962 Johnson ..... E02F 3/401 37/409
4,286,917 A * 9/1981 Mehesan, Jr. ..... A22B 7/006 414/704
4,295,771 A * 10/1981 Mehesan, Jr. ..... B66F 9/0655 414/718
4,542,929 A 9/1985 Possinger
5,160,239 A * 11/1992 Allen ..... E02F 9/2025 700/65
5,242,258 A * 9/1993 Weyer ..... E02F 3/3618 37/468
5,244,066 A * 9/1993 Mackoway ..... E02F 9/2004 74/491
5,375,348 A * 12/1994 Kishi ..... E02F 9/2221 414/722
5,424,623 A * 6/1995 Allen ..... B25J 9/162 180/324
5,472,308 A * 12/1995 Somero ..... E02F 3/963 37/406
5,553,408 A * 9/1996 Townsend ..... E02F 3/404 414/722
5,813,822 A * 9/1998 Pisco ..... E02F 3/4135 414/723
6,126,216 A 10/2000 Tollefson
6,135,290 A * 10/2000 Heiple ..... E02F 3/407 209/418
6,148,254 A * 11/2000 Barden ..... E02F 3/435 701/50
6,203,267 B1 * 3/2001 Heiple ..... E02F 3/965 414/722
6,332,747 B1 * 12/2001 Lee ..... E02F 3/3636 37/468
6,385,870 B1 * 5/2002 Webel ..... E02F 9/2004 37/406
6,450,081 B1 * 9/2002 Sorbel ..... F15B 11/028 91/461
6,742,291 B2 * 6/2004 Frigon ..... E02F 3/404 414/722
7,617,619 B2 * 11/2009 Cox ..... E02F 3/404 37/406
9,404,236 B2 * 8/2016 Toraason ..... E02F 3/404
2002/0101107 A1 * 8/2002 Cunningham ..... E02F 3/404 297/377
2003/0167662 A1 * 9/2003 Desrochers ..... E02F 3/404 37/406
2005/0193599 A1 * 9/2005 McCoy ..... E02F 3/404 37/406
2006/0045714 A1 * 3/2006 Risch ..... E02F 3/3677 414/722
2006/0150446 A1 * 7/2006 Ottoni ..... E02F 3/404 37/406
2008/0011155 A1 * 1/2008 Connolly ..... E02F 9/2203 91/508
2008/0086920 A1 4/2008 Lim
2009/0259373 A1 * 10/2009 Nichols ..... E02F 9/264 701/50
2009/0282710 A1 * 11/2009 Johnson ..... E02F 3/404 37/444
2009/0290966 A1 * 11/2009 King ..... B66C 3/02 414/739
2010/0312437 A1 * 12/2010 Saito ..... E02F 3/434 701/50
2013/0129461 A1 * 5/2013 Seljestad ..... E02F 9/26 414/724
2013/0216347 A1 * 8/2013 Breuer ..... E02F 3/404 414/739
2015/0081176 A1 * 3/2015 Paull ..... E02F 3/433 701/50
2016/0312433 A1 * 10/2016 Parker ..... E02F 3/3677
2017/0002545 A1 * 1/2017 Kaneta ..... F15B 11/08
2017/0022684 A1 * 1/2017 Simpson ..... B23D 33/00
2017/0342687 A1 * 11/2017 Iwamura ..... E02F 9/2033
2019/0100896 A1 * 4/2019 Frey ..... E02F 3/404
2019/0127947 A1 * 5/2019 Zent ..... E02F 9/2267
2019/0136489 A1 * 5/2019 Bolz ..... E02F 9/205

OTHER PUBLICATIONS

International Search Report and Written Opinion in corresponding International Application No. PCT/EP2018/059513 dated Jun. 26, 2018 (9 pages).

* cited by examiner

CONTROL SYSTEMS FOR AN EXCAVATOR AND METHODS FOR CONTROLLING AN EXCAVATOR WITH A MOVABLE EXCAVATOR THUMB AND AN AUXILIARY TOOL HOLD BY AN TILTROTATOR

CROSS-REFERENCE TO RELATED APPLICATIONS

This application is a U.S. National Stage application of PCT/EP2018/059513, filed Apr. 13, 2018 and published on Oct. 25, 2018 as WO/2018/192850, which claims the benefit of Swedish Patent Application No. 1750458-0, filed Apr. 19, 2017, all of which are hereby incorporated by reference in their entireties.

TECHNICAL FIELD

Aspects of the present invention relate to control systems for an excavator, which comprises a movable arm, a movable excavator thumb and a tiltrotator attached to the arm, the tiltrotator being arranged to hold an auxiliary tool which is rotatable and/or tiltable by means of the tiltrotator. Further aspects of the present invention relate to methods for controlling an excavator disclosed above. Aspects of the present invention also relate to a tiltrotator and an excavator each comprising a control system.

BACKGROUND

Excavators may be stationary or movable by being wheeled or provided with continuous tracks. Excavators often use hydraulics, such as hydraulic cylinders, to move and operate an auxiliary tool held by an arm of the excavator. A combined rotating and tilting unit, arranged to hold the auxiliary tool, is known as a tiltrotator. Some excavators are equipped with such a tiltrotator which is attached to the arm of the excavator. By way of the tiltrotator the auxiliary tool can both be tilted and rotated, providing an advantageous flexibility when operating the excavator.

SUMMARY

Some excavators provided with a tiltrotator are also equipped with an excavator thumb, which may be pivotally attached to the arm of the excavator. A joint of the excavator thumb may also be combined with a joint of the auxiliary tool. The excavator thumb is arranged to cooperate with the auxiliary tool, e.g. the bucket, to grip/clamp and lift an object. The inventor of the present invention has identified that it may be problematic to combine the tiltrotator and the excavator thumb. When the tiltrotator has rotated and/or tilted the bucket away from the excavator thumb, the bucket and excavator thumb cannot properly grip an object. Further, the inventor of the present invention has realised that the equipment may be damaged or that objects accidently can be dropped, creating a safety risk, if the excavator thumb is operated when the auxiliary tool is not in a suitable position.

An object of embodiments of the present invention is to improve the operation of both an excavator thumb and an auxiliary tool attached to a tiltrotator.

According to a first aspect of the present invention, the above-mentioned object is attained by providing a control system for an excavator, the excavator comprising a movable arm, a movable excavator thumb and a tiltrotator attached to the arm. The tiltrotator is arranged to hold an auxiliary tool which is rotatable and/or tiltable by means of the tiltrotator. The control system is arranged to receive manoeuvring input from a manoeuvring device manoeuvred by an operator. The control system is arranged to control the tiltrotator to rotate and/or tilt the auxiliary tool between a plurality of first positions and at least one second position. The excavator thumb is movable between at least one rest position and a plurality of work positions. The auxiliary tool is arranged to cooperate with the excavator thumb, e.g. to grip/clamp and lift an object, when the auxiliary tool is positioned in any of the at least one second position and when the excavator thumb is positioned in any of the plurality of work positions. The control system comprises a first blocker arranged to block the movement of the excavator thumb when the auxiliary tool is positioned in any of the plurality of first positions.

According to a second aspect of the present invention, the above-mentioned object is attained by providing a control system for an excavator, the excavator comprising a movable arm, a movable excavator thumb and a tiltrotator attached to the arm, the tiltrotator being arranged to hold an auxiliary tool which is rotatable and/or tiltable by means of the tiltrotator. The control system is arranged to receive manoeuvring input from a manoeuvring device manoeuvred by an operator, wherein the control system is arranged to control the tiltrotator to rotate and/or tilt the auxiliary tool between a plurality of first positions and at least one second position. The excavator thumb is movable between at least one rest position and a plurality of work positions. The auxiliary tool is arranged to cooperate with the excavator thumb, e.g. to grip/clamp and lift an object, when the auxiliary tool is positioned in any of the at least one second position and when the excavator thumb is positioned in any of the plurality of work positions. The control system comprises a second blocker arranged to block the rotation and/or tilting of the auxiliary tool when the excavator thumb is positioned in any of the plurality of work positions.

The excavator may be a hydraulic excavator. In a hydraulic excavator, the movements of the arm, the tiltrotator, the excavator thumb and the auxiliary tool may be effected by means of hydraulics, e.g. hydraulic cylinders. However, equipment of the excavator may also be mechanically operated, e.g. the excavator thumb. The auxiliary tool may be a bucket, or any other suitable tool.

The control system may be arranged to control the excavator thumb to move between the at least one rest position and the plurality of work positions.

By means of the control systems as disclosed above, the control of the tiltrotator in combination with the excavator thumb is improved. Further, the risk of damaging the equipment, e.g. the tiltrotator, is reduced. Further, it is assured that the bucket and the excavator thumb can cooperate, e.g. properly grip an object in a secure manner, and accidently dropping an object is prevented.

According to an advantageous embodiment of the control system according to the present invention, the first blocker is arranged to block manoeuvring input from the manoeuvring device requesting movement of the excavator thumb when the auxiliary tool is positioned in any of the plurality of first positions.

According to a further advantageous embodiment of the control system according to the present invention, where the control system comprises a first blocker, the control system comprises a second blocker arranged to block the rotation and/or tilting of the auxiliary tool when the excavator thumb is positioned in any of the plurality of work positions.

According to another advantageous embodiment of the control system according to the present invention, the second blocker is arranged to block manoeuvring input from the manoeuvring device requesting rotation and/or tilting of the auxiliary tool when the excavator thumb is positioned in any of the plurality of work positions.

According to yet another advantageous embodiment of the control system according to the present invention, the control system comprises at least one first sensor arranged to detect that the auxiliary tool is positioned in any of the at least one second position.

According to still another advantageous embodiment of the control system according to the present invention, the manoeuvring device comprises a quick command, and when activated by the operator, the control system is arranged to rotate and/or tilt the auxiliary tool to the at least one second position without any further manoeuvring input from the manoeuvring device.

According to an advantageous embodiment of the control system according to the present invention, the control system comprises at least one second sensor arranged to detect that the excavator thumb is positioned in any of the at least one rest position.

According to a third aspect of the present invention, the above-mentioned object is attained by providing a method for controlling an excavator, the excavator comprising a movable arm, a movable excavator thumb and a tiltrotator attached to the arm, the tiltrotator being arranged to hold an auxiliary tool which is rotatable and/or tiltable by means of the tiltrotator, the method comprising the steps of:

- receiving manoeuvring input from a manoeuvring device manoeuvred by an operator;
- detecting the position of the auxiliary tool between a plurality of first positions and at least one second position; and
- blocking the movement of the excavator thumb when the auxiliary tool is positioned in any of the plurality of first positions.

According to a fourth aspect of the present invention, the above-mentioned object is attained by providing a method for controlling an excavator, the excavator comprising a movable arm, a movable excavator thumb and a tiltrotator attached to the arm, the tiltrotator being arranged to hold an auxiliary tool which is rotatable and/or tiltable by means of the tiltrotator, the method comprising the steps of:

- receiving manoeuvring input from a manoeuvring device manoeuvred by an operator;
- detecting the position of the excavator thumb between at least one rest position and a plurality of work positions; and
- blocking the rotation and/or tilting of the auxiliary tool when the excavator thumb is positioned in any of the plurality of work positions.

According to an advantageous embodiment of the method according to the present invention, the step of blocking the movement of the excavator thumb comprises blocking the manoeuvring input from the manoeuvring device requesting movement of the excavator thumb.

According to a further advantageous embodiment of the control system according to the present invention, the method comprises the step of

- blocking the rotation and/or tilting of the auxiliary tool when the excavator thumb is positioned in any of the plurality of work positions.

According to another advantageous embodiment of the control system according to the present invention, the step of blocking the rotation and/or tilting of the auxiliary tool comprises blocking the manoeuvring input from the manoeuvring device requesting rotation and/or tilting of the auxiliary tool.

According to a fifth aspect of the present invention, the above-mentioned object is attained by providing a tiltrotator arranged to be attached to an arm of an excavator and arranged to hold an auxiliary tool, wherein the tiltrotator comprises a control system as claimed in any of the claims 1 to 8 or as disclosed above or below.

According to a sixth aspect of the present invention, the above-mentioned object is attained by providing an excavator comprising an arm, an excavator thumb and a tiltrotator attached to the arm, the tiltrotator being arranged to hold an auxiliary tool, wherein the excavator comprises a control system as claimed in any of the claims 1 to 8 or as disclosed above or below.

Positive technical effects of the embodiments of the methods, tiltrotator and excavator may correspond to the technical effects mentioned in connection with the embodiments of the control system.

In this disclosure, the wording "between a plurality of first positions and at least one second position" includes the plurality of first positions and the at least one second position. In this disclosure, the wording "between at least one rest position and a plurality of work positions" includes the at least one rest position and the plurality of work positions.

The above-mentioned features and embodiments, respectively, may be combined in various possible ways providing further advantageous embodiments. Advantageous embodiments of the control systems, the method, the tiltrotator and the excavator according to aspects of the present invention and further advantages emerge from the dependent claims and the detailed description of embodiments.

BRIEF DESCRIPTION OF THE DRAWINGS

Embodiments of the present invention will now be described, for exemplary purposes, in detail with reference to the enclosed drawings, in which.

DETAILED DESCRIPTION OF EMBODIMENTS

Figure 1:
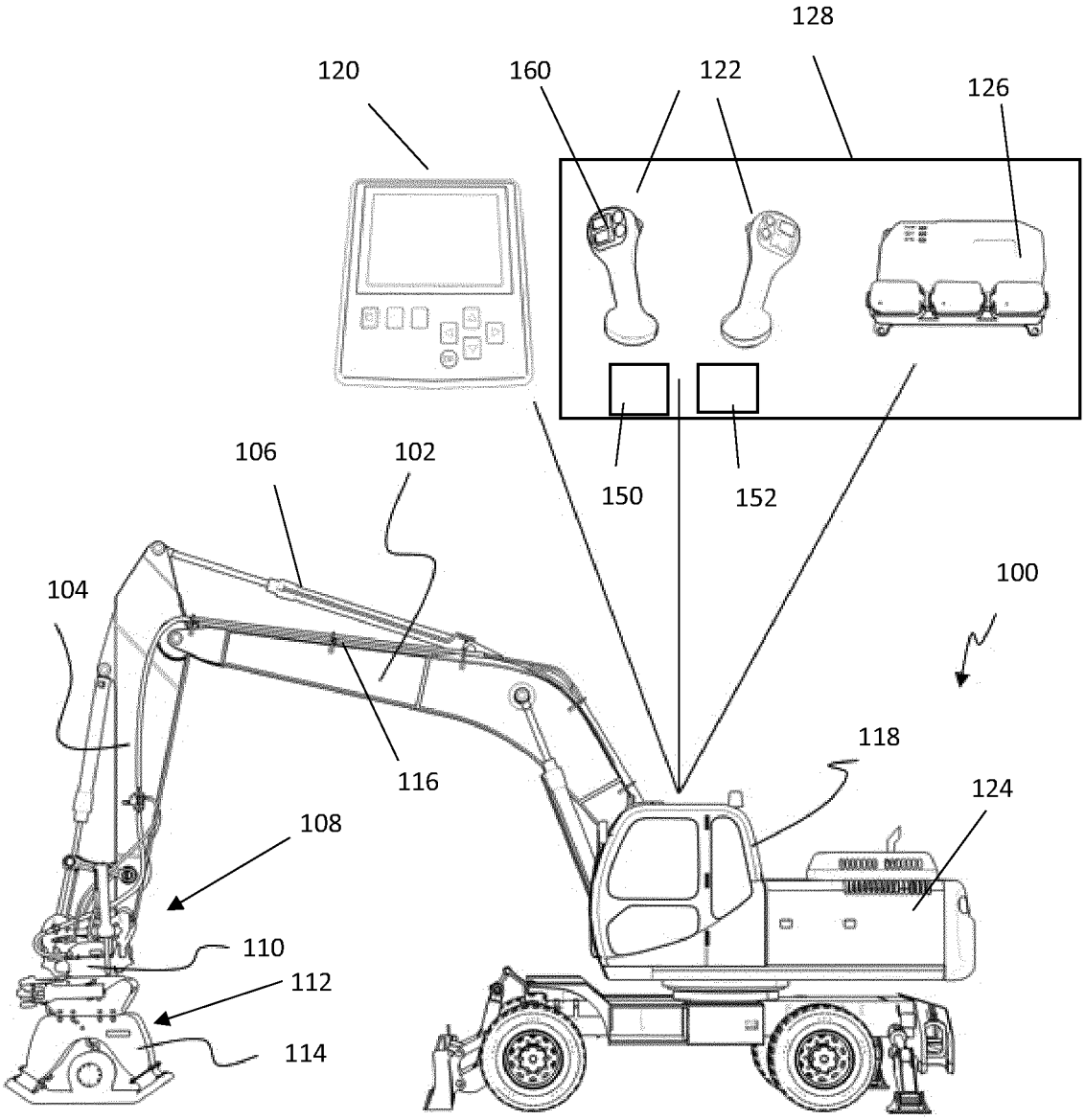
FIG. 1 is a schematic illustration of an excavator that includes aspects of the present invention.

FIG. 1 schematically shows a wheeled excavator 100 with a boom 102 and an arm 104 that is pivotally arranged on the boom 102. Hydraulic cylinders 106 are arranged to achieve the pivoting movement. At the free end 108 of the arm 104 a tiltrotator 110 is arranged. An auxiliary tool 112 in the form of a compactor 114 is attached to the tiltrotator 110. However, it is to be understood that the auxiliary tool may be any suitable tool, e.g. a bucket. A common supply line 116 is arranged to provide the tools arranged at the free end 108 of the pivot arm 104 with pressurized hydraulic fluid.

The excavator 100 comprises a cabin 118 in which a display 120 is arranged. The display 120 is arranged to display the mode and position of the tiltrotator 110 and the auxiliary tool 112, respectively. The display may also be arranged to display the mode and position of an excavator thumb 232 (see FIG. 2) Further, the excavator 100 includes a manoeuvring unit 122 for manoeuvring at least the tiltrotator 110 and the auxiliary tool 112. A hydraulic block 124 is provided on the excavator 100 to regulate the hydraulic fluid and to provide hydraulic fluid to the functions demanding it. A control unit 126 is arranged to govern the hydraulic system of the tiltrotator 110. The control unit 126 may also be arranged to govern the hydraulic system of the excavation thumb 232 (see FIG. 5). The control unit 126 may be located in the cabin 118 or outside the cabin 118, e.g. on the tiltrotator 110 or on the arm 104. The control unit 126 is arranged to collect information from the manoeuvring unit 122 and to govern the hydraulic valves of the tiltrotator 110 and excavator thumb 232 and the hydraulic block 124 based on this information.

Figure 2:
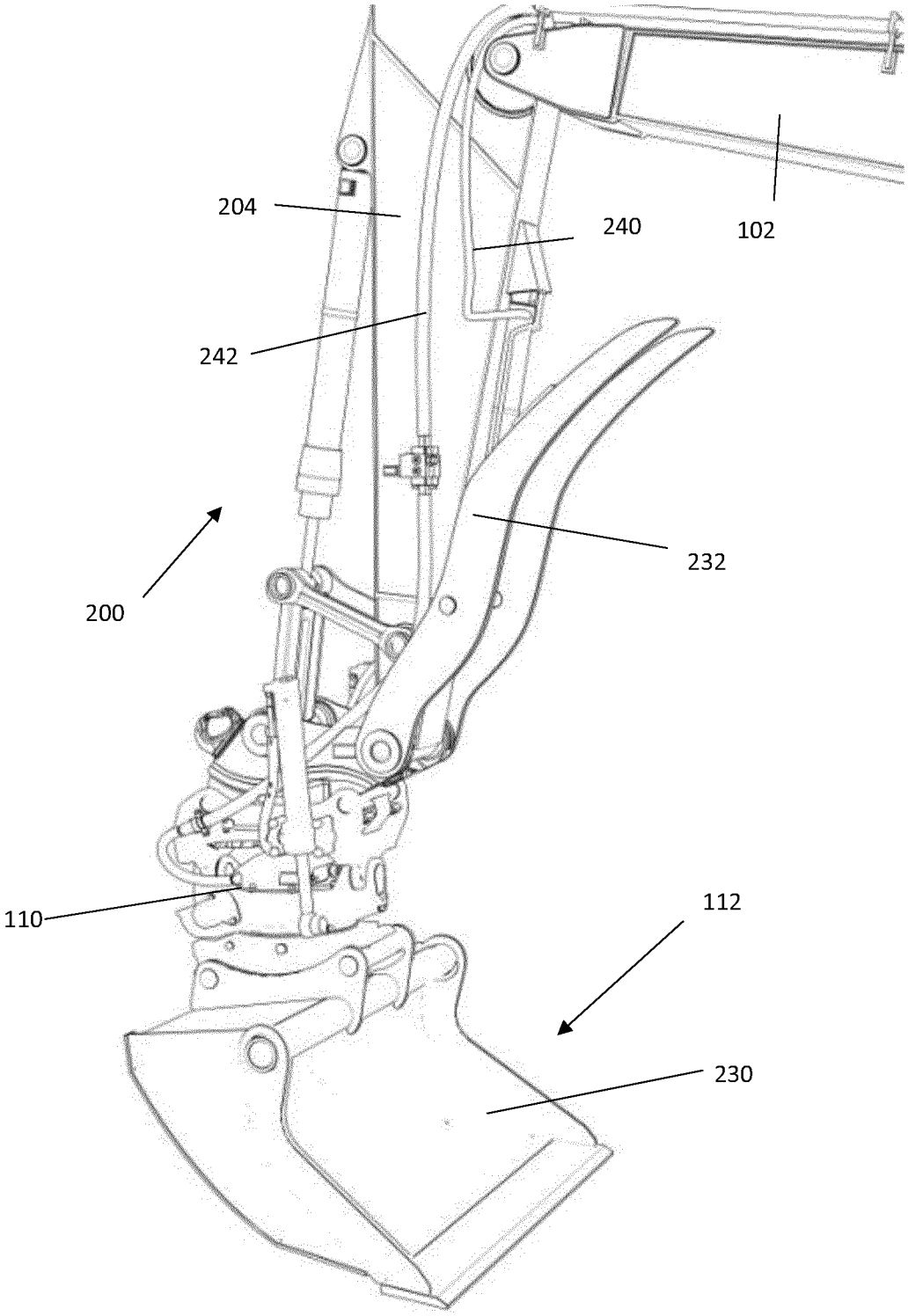
FIG. 2 is a schematic partial perspective view of embodiments of the excavator and tiltrotator controlled by the control system according to aspects of the present invention.

With reference to FIG. 1, a control system 128 of the excavator 100, 200 is provided. The control system 128 may be arranged to communicate with the control unit 126. With reference to FIG. 2, the excavator 200 comprises a movable arm 204 and a tiltrotator 110 which is attached to the arm 204. The tiltrotator 110 is arranged to hold an auxiliary tool 112. In the embodiments of FIGS. 2-5, the auxiliary tool 112 is a bucket 230. However, other tools may be used. The bucket 230 is rotatable and/or tiltable in relation to the arm 204 by means of the tiltrotator 110. Further, the excavator 200 comprises a movable excavator thumb 232 which is movable in relation to the arm 204 and may be pivotally attached to the arm 204. Alternatively, the excavator thumb may be pivotally attached to the auxiliary tool, or one joint of the excavator thumb may be combined with a joint of the auxiliary tool, e.g. the bucket. The control system 128 is arranged to receive manoeuvring input from the manoeuvring device 122 manoeuvred by an operator. The control system 128 is arranged to control the tiltrotator 110 to rotate and/or tilt the auxiliary tool 112 between a plurality of first positions and at least one second position. The excavator thumb 232 is movable between at least one rest position and a plurality of work positions. The control system 128 may be arranged to control the excavator thumb 232 and control the excavator thumb 232 to move between the at least one rest position and the plurality of work positions.

Figure 5:
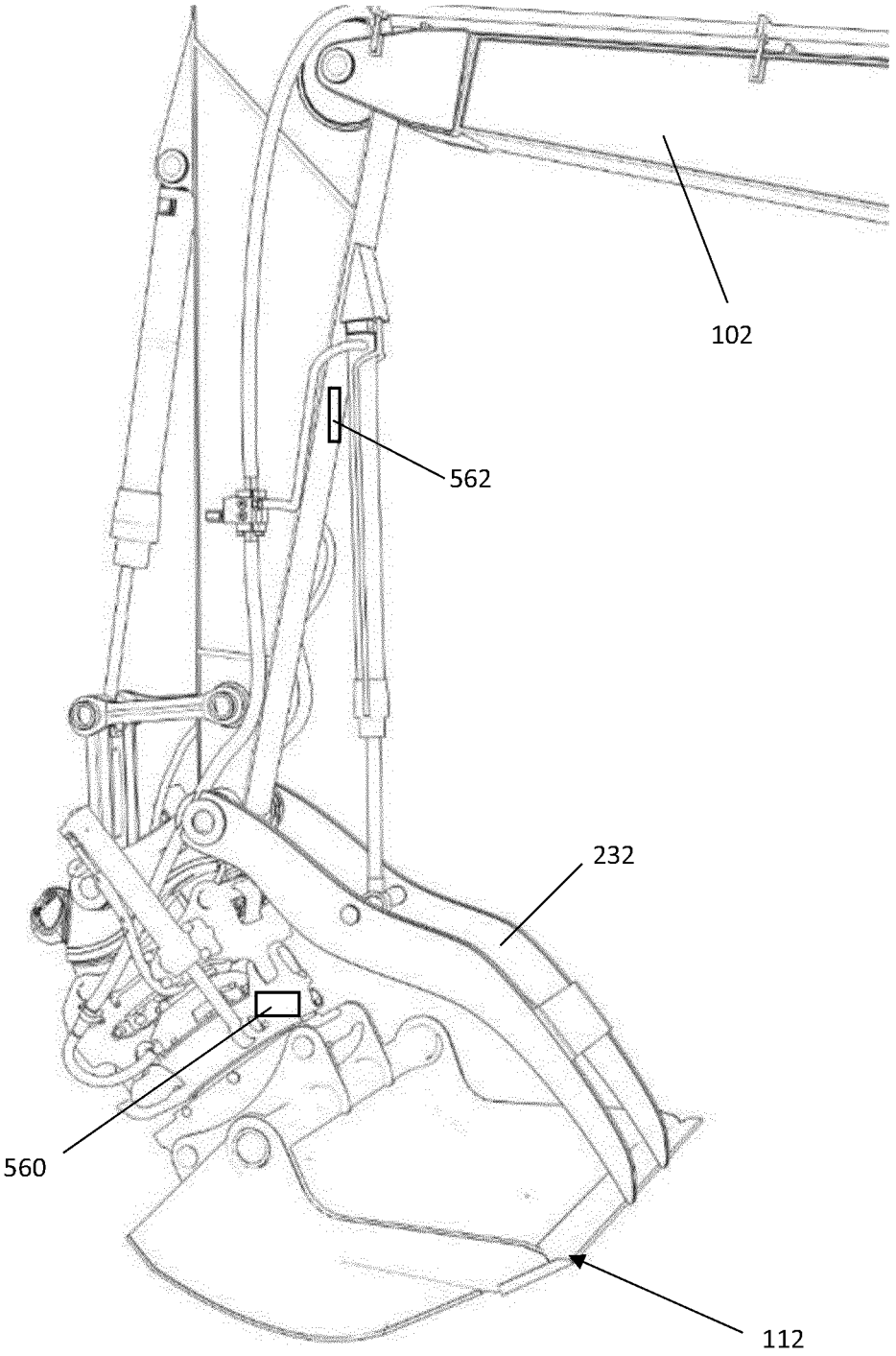
FIG. 5 shows the excavator and tiltrotator of FIG. 4 but with the excavator thumb in a different position.

In FIG. 2, the auxiliary tool 112 is in the at least one second position, and the excavator thumb 232 is in the at least one rest position. However, it is to be understood that the auxiliary tool 112 may be movable to a plurality of second positions and that the excavator thumb 232 may be movable to a plurality of rest positions. With reference to FIG. 5, the auxiliary tool 112 is arranged to cooperate with the excavator thumb 232, e.g. gripping an object, when the auxiliary tool 112 is positioned in any of the at least one second position and when the excavator thumb 232 is positioned in any of the plurality of work positions. The auxiliary tool 112 and the excavator thumb 232 can grip an object by moving the excavator thumb 232 toward the auxiliary tool 112 until a suitable or firm grip of the object is attained, whereas the auxiliary tool 112 is not moved toward the excavator thumb 232. When moving the excavator thumb 232 toward the auxiliary tool 112 for properly gripping an object, the auxiliary tool 112 is positioned in any of the at least one second position and the excavator thumb 232 is positioned in any of the plurality of work positions.

In another example, the auxiliary tool 112 and the excavator thumb 232 may be both moved toward one another to suitably or firmly grip an object between them. Also in this example, the auxiliary tool 112 is positioned in any of the at least one second position and the excavator thumb 232 is positioned in any of the plurality of work positions.

Figure 6:
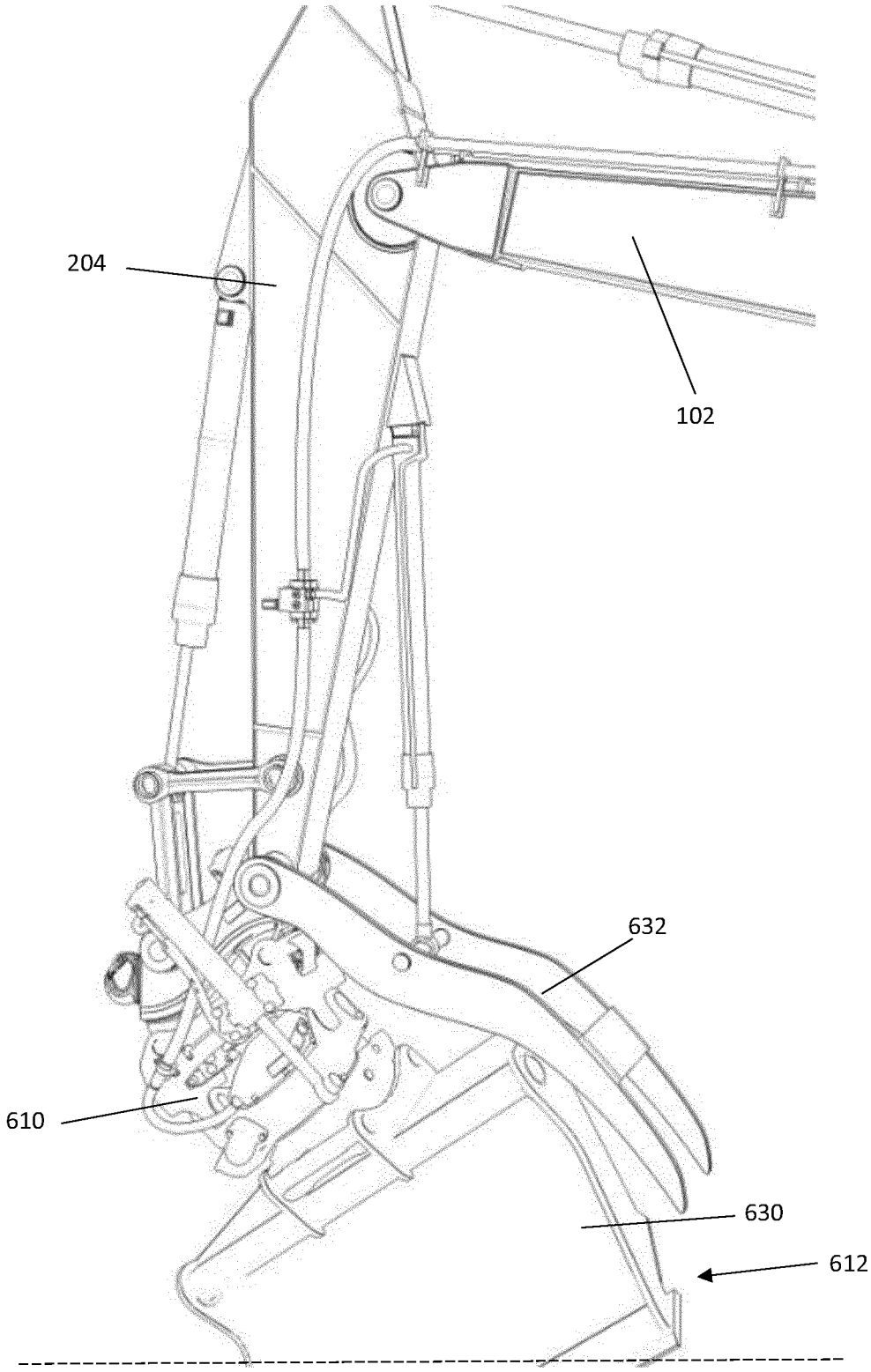
FIG. 6 shows an example of an unwanted position of the excavator thumb and the auxiliary tool in combination.

The control system 128 may comprise a first blocker 150 arranged to block the movement of the excavator thumb 232 when the auxiliary tool 112 is positioned in any of the plurality of first positions. In FIG. 2, the excavator thumb is in a rest position. FIG. 6 schematically illustrates when the auxiliary tool 612 is in any of the plurality of first positions while the excavator thumb 632 is in a work position, i.e. when the auxiliary tool 612, which is held by the tiltrotator 610, and the excavator thumb 632 together are in an unwanted position. As seen in FIG. 6, the opening 630 of the bucket of the auxiliary tool 612 is rotated away from the excavator thumb 632. With reference to FIG. 1, the control system 128 may comprise a second blocker 152 arranged to block the rotation and/or tilting of the auxiliary tool 112 when the excavator thumb 232 is positioned in any of the plurality of work positions. By combining the first and second blockers 150, 152 advantageous embodiments are provided which improve the control of the tiltrotator 110 in combination with the excavator thumb 232 and reduce the risk of damaging the equipment, e.g. the tiltrotator. Further, by the combination of the first and second blockers 150, 152 it is assured that the bucket and the excavator thumb can properly grip an object and not drop it, whereby the safety is improved. However, it is to be understood that some embodiments may only have the first blocker 150 and that other embodiments may only have the second blocker 152.

The excavator thumb 232 and the auxiliary tool 112 may be arranged to cooperate by being able to grip/clamp an object and lift and move the object. An object between the excavator thumb 232 and auxiliary tool 112 may for example be clamped by moving the excavator thumb 232 towards the auxiliary tool 112 until a suitable grip is attained. The auxiliary tool 112 may be a scoop 230 or any other suitable tool.

The control system 128 including the two blockers 150, 152 may be implemented as software. However, the two blockers may be implemented in an alternative manner. The two blockers 150, 152 may e.g. arranged to block the hydraulic fluid to the tiltrotator 110 and excavator thumb 232.

Figure 3:
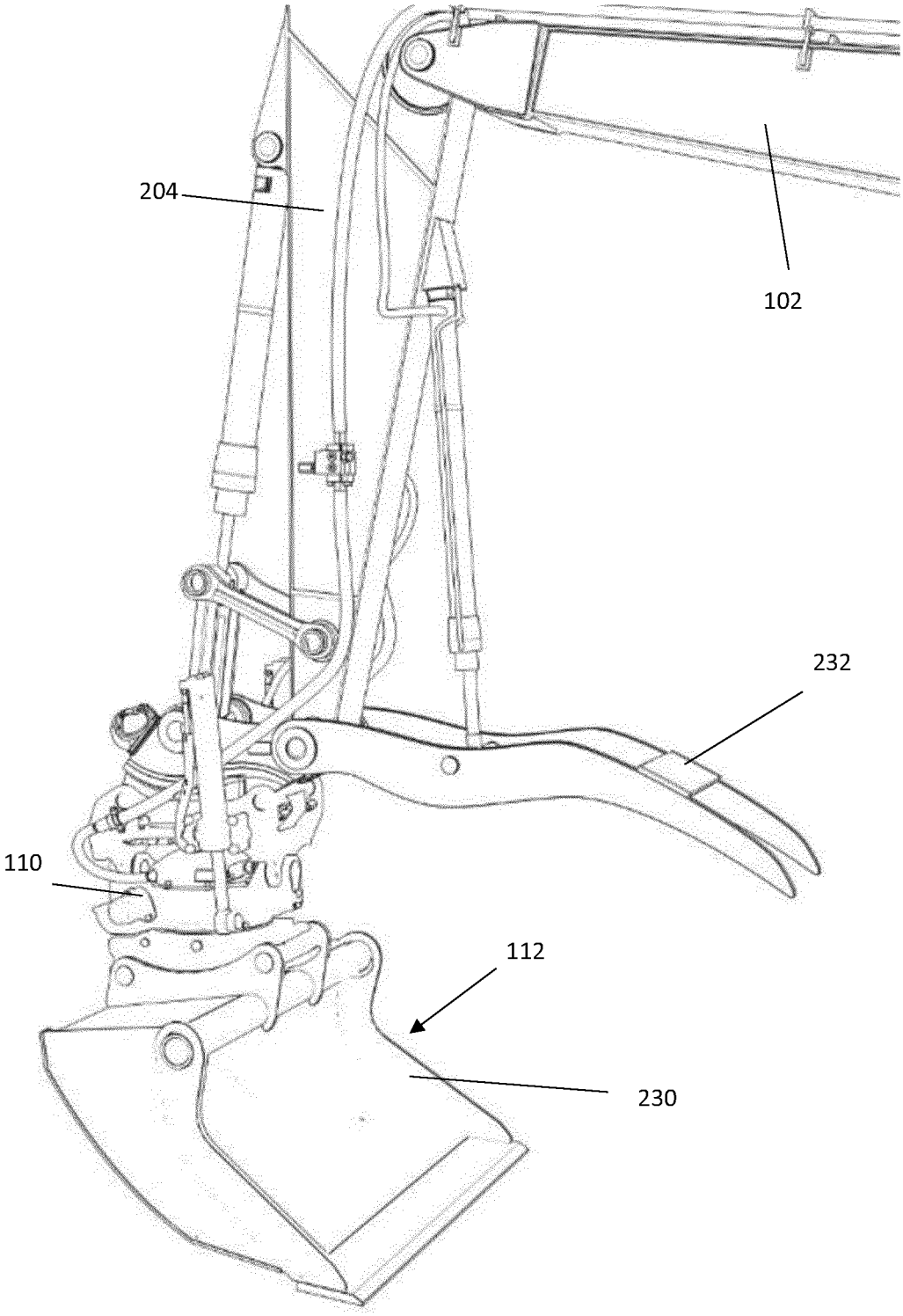
FIG. 3 shows the excavator and tiltrotator of FIG. 2 but with the excavator thumb in a different position.
Figure 4:
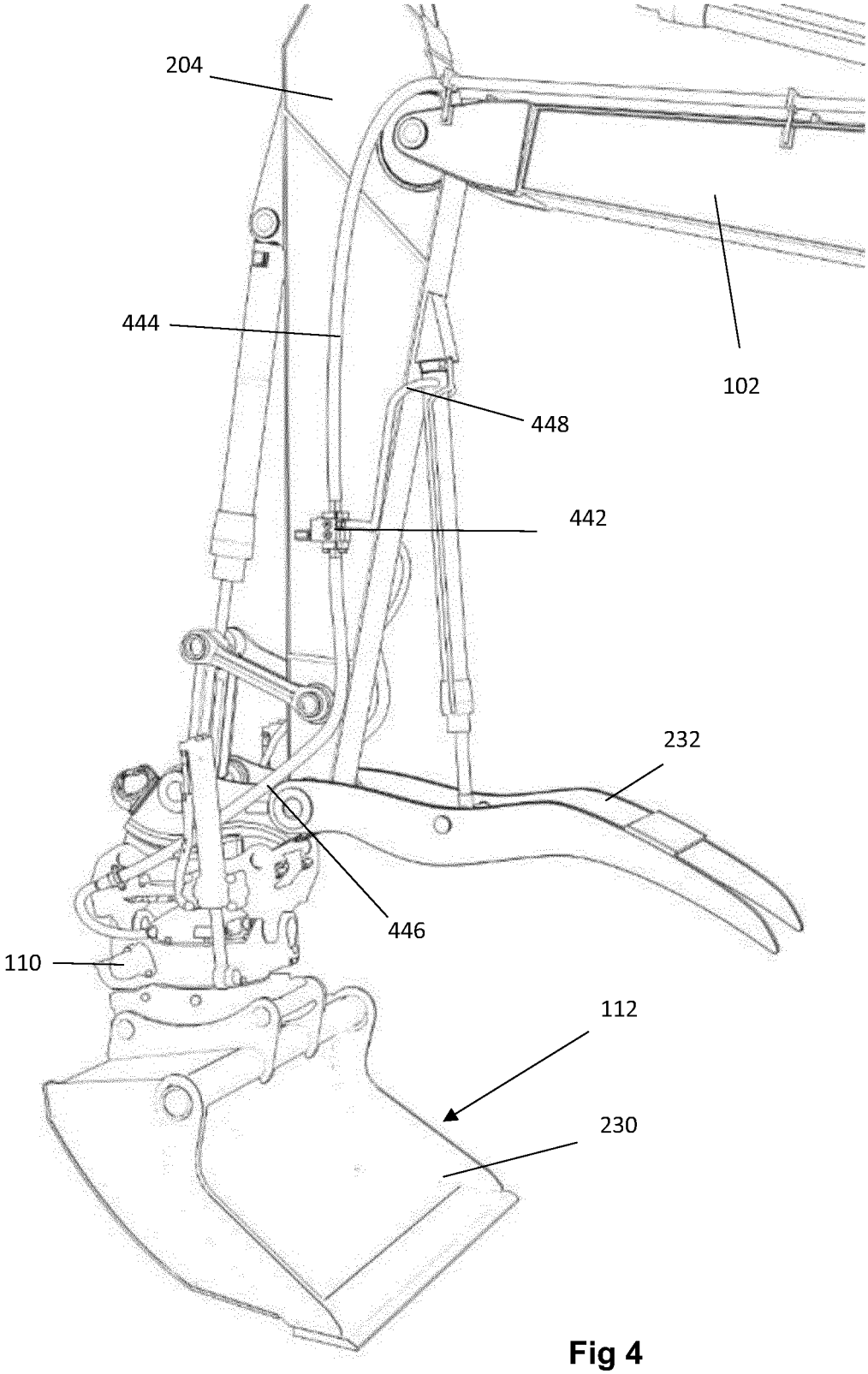
FIG. 4 is a schematic partial perspective view of a further embodiment of the excavator and tiltrotator controlled by the control system according to aspects of the present invention.

FIG. 3 corresponds essentially to FIG. 2, but with the excavator thumb 232 in a work position. In FIG. 3 the auxiliary tool 112 and excavator thumb 232 are prepared to grip/clamp an object. FIG. 4 illustrates other embodiments of the excavator and tiltrotator. FIG. 4 differs from FIG. 3 in that the supply lines 440 of hydraulic fluid are arranged in different manners. More specifically, in FIG. 4 there is a diverter valve 442 arranged on the arm 204 at the end of a common supply line 444 close to the tiltrotator 110. The diverter valve 442 diverts the hydraulic fluid into two separate conduits. A first conduit 446 is provided to the tiltrotator 110, and a second conduit 448 is provided to the excavator thumb 232. In FIGS. 2-3, the excavator thumb 232 and the tiltrotator 110 are provided with separate conduits 240, 242 from the hydraulic block 124. FIG. 5 shows the embodiment of FIG. 4 but with the excavator thumb 232 in another work position.

With reference to FIGS. 1 and 5, the first blocker 150 is arranged to block manoeuvring input from the manoeuvring device 122 requesting movement of the excavator thumb 232 when the auxiliary tool 112 is positioned in any of the plurality of first positions. The second blocker 152 may be arranged to block manoeuvring input from the manoeuvring device 122 requesting rotation and/or tilting of the auxiliary tool 112 when the excavator thumb 232 is positioned in any of the plurality of work positions. The control system 128 comprises at least one first sensor 560, e.g. two sensors, arranged to detect that the auxiliary tool 112 is positioned in any of the at least one second position. The control system 128 comprises at least one second sensor 562 arranged to detect that the excavator thumb 232 is positioned in any of the at least one rest position. An alternative to the second sensor 562 may be based on a scheme where the operator of the excavator indicates that the excavator thumb is in a rest position before the tiltrotator can be operated. The manoeuvring device 122 may comprise a quick command 160 (see FIG. 1). When the quick command is activated by the operator, the control system 128 is arranged to rotate and/or tilt the auxiliary tool 112 to the at least one second position without any further manoeuvring input from the manoeuvring device 122. The quick command 160 provides an efficient way for the operator to put the auxiliary tool 112 in a correct position for cooperation with the excavator thumb 232. Alternatively, the control system 128 may comprise one or more sensors that detect the position of the auxiliary tool 112 in any position. The control system 128 may comprise one or more sensors that detect the position of the excavation thumb 232 in any position. The control system may for example comprise two sensors 560 applied to the tiltrotator 110, where one sensor detects the rotation of the tiltrotator 110 and another sensor detects the tilting of the tiltrotator 110.

Figure 7:
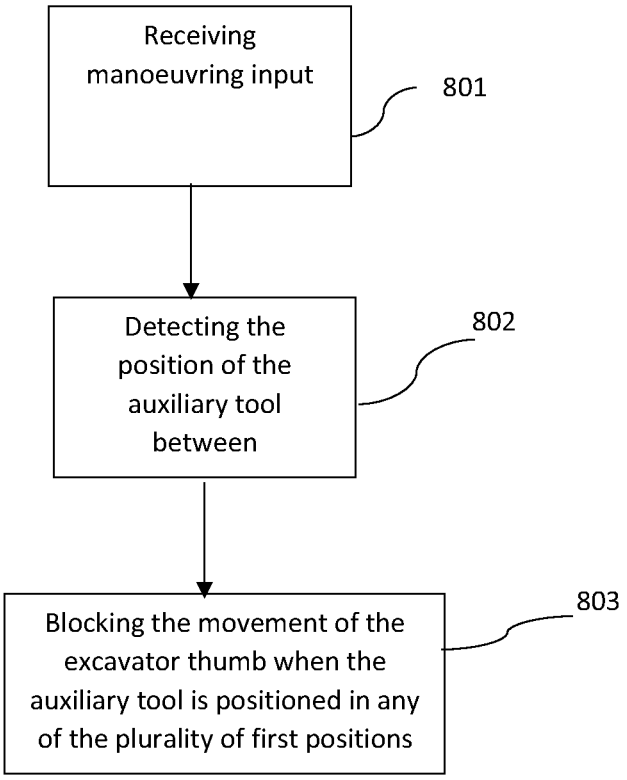
FIG. 7 schematically illustrates aspects of a method according to the present invention.

According to aspects of the present invention, embodiments of a method for controlling an excavator are provided as shown in FIG. 7, the method comprising the steps of:

- receiving 801 manoeuvring input from a manoeuvring device manoeuvred by an operator;
- detecting 802 the position of the auxiliary tool between a plurality of first positions and at least one second position; and
- blocking 803 the movement of the excavator thumb when the auxiliary tool is positioned in any of the plurality of first positions.

The step of blocking the movement of the excavator thumb may comprise blocking the manoeuvring input from the manoeuvring device requesting movement of the excavator thumb.

Figure 8:
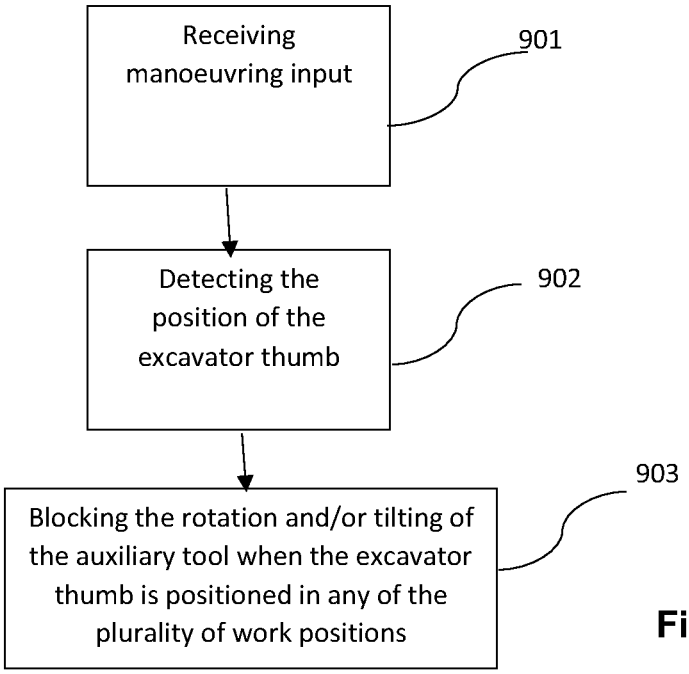
FIG. 8 schematically illustrates aspects of another method according to the present invention.

According to further aspects of the present invention, embodiments of a method for controlling an excavator are provided as shown in FIG. 8, the method comprising the steps of

- receiving 901 manoeuvring input from a manoeuvring device manoeuvred by an operator;
- detecting 902 the position of the excavator thumb between at least one rest position and a plurality of work positions; and
- blocking 903 the rotation and/or tilting of the auxiliary tool when the excavator thumb is positioned in any of the plurality of work positions.

The step of blocking the rotation and/or tilting of the auxiliary tool may comprise blocking the manoeuvring input from the manoeuvring device requesting rotation and/or tilting of the auxiliary tool.

Aspects of the present invention include a tiltrotator arranged to be attached to an arm of an excavator and arranged to hold an auxiliary tool, wherein the tiltrotator comprises a control system as disclosed above in connection with various embodiments.

Aspects of the present invention include an excavator 100, 200 which comprises an arm 104, 204 an excavator thumb 232 and a tiltrotator 110 attached to the arm 204, wherein the tiltrotator 110 is arranged to hold an auxiliary tool 112, and wherein the excavator 100, 200 comprises a control system 128 according to any embodiment as disclosed above. The excavator 100, 200 may be a tractor or any other suitable vehicle or apparatus. Embodiments of the excavator 100, 200 may be stationary or movable by being wheeled or provided with continuous tracks. The excavators may use hydraulics, such as hydraulic cylinders to move parts of the excavator.

It is to be understood that other means than the hydraulic means disclosed above can be used, e.g. pneumatic means.

An advantageous scheme that can be combined with embodiments of the present invention is that the auxiliary tools to be used are marked with an identity, e.g. by being provided with an RFID or Bluetooth tag/mark, and are automatically identified by the control system. When identified, the control system can block the use of the excavator thumb if a certain auxiliary tool is attached to the tiltrotator. An alternative is for the operator to manually provide the control system with the tool identity to be connected to the tiltrotator.

The features of the various embodiments disclosed above may be combined in various possible ways providing further advantageous embodiments.

In the embodiments disclosed above, a bucket is attached to the tiltrotator. However, it is to be understood that other auxiliary tools may be attached to the tiltrotator.

The invention shall not be considered limited to the embodiments illustrated, but can be modified and altered in many ways by one skilled in the art, without departing from the scope of the appended claims.

The invention claimed is:

1. A control system for an excavator, the excavator comprising a movable arm, a movable excavator thumb and a tiltrotator attached to the arm, the tiltrotator being arranged to hold an auxiliary tool which is rotatable and/or tiltable by means of the tiltrotator, wherein the control system is arranged to receive manoeuvring input from a manoeuvring device manoeuvred by an operator, wherein the control system is arranged to control the tiltrotator to rotate and/or tilt the auxiliary tool between a plurality of first positions and at least one second position, and the excavator thumb is movable between at least one rest position and a plurality of work positions, wherein the auxiliary tool is arranged to cooperate with the excavator thumb when the auxiliary tool is positioned in any of the at least one second position and when the excavator thumb is positioned in any of the plurality of work positions, wherein the control system comprises a first blocker including at least one of 1) a non-transitory computer readable medium storing program code, that when executed by the control system, cause the control system to block the movement of the excavator thumb when the auxiliary tool is positioned in any of the plurality of first positions, or 2) the first blocker being configured to block the movement of the excavator thumb when the auxiliary tool is positioned in any of the plurality of first positions by blocking the hydraulic fluid to the excavator thumb.

2. A control system according to the claim 1, characterised in that the first blocker is arranged to block manoeuvring input from the manoeuvring device requesting movement of the excavator thumb when the auxiliary tool is positioned in any of the plurality of first positions.

3. A control system according to claim 1, characterised in that the control system comprises a second blocker arranged to block the rotation and/or tilting of the auxiliary tool when the excavator thumb is positioned in any of the plurality of work positions.

4. A control system according to claim 1, characterised in that the control system comprises at least one first sensor arranged to detect that the auxiliary tool is positioned in any of the at least one second position.

5. A control system according to claim 4, characterised in that the manoeuvring device comprises a quick command, and when activated by the operator, the control system is arranged to rotate and/or tilt the auxiliary tool to the at least one second position without any further manoeuvring input from the manoeuvring device.

6. A control system according to claim 1, characterised in that the control system comprises at least one second sensor arranged to detect that the excavator thumb is positioned in any of the at least one rest position.

7. A tiltrotator arranged to be attached to an arm of an excavator and arranged to hold an auxiliary tool, wherein the tiltrotator comprises a control system as claimed in claim 1.

8. An excavator comprising an arm, an excavator thumb and a tiltrotator attached to the arm, the tiltrotator being arranged to hold an auxiliary tool, wherein the excavator comprises a control system as claimed in claim 1.

9. A control system for an excavator, the excavator comprising a movable arm, a movable excavator thumb and a tiltrotator attached to the arm, the tiltrotator being arranged to hold an auxiliary tool which is rotatable and/or tiltable by means of the tiltrotator, wherein the control system is arranged to receive manoeuvring input from a manoeuvring device manoeuvred by an operator, wherein the control system is arranged to control the tiltrotator to rotate and/or tilt the auxiliary tool between a plurality of first positions and at least one second position, and the excavator thumb is movable between at least one rest position and a plurality of work positions, wherein the auxiliary tool is arranged to cooperate with the excavator thumb when the auxiliary tool is positioned in any of the at least one second position and when the excavator thumb is positioned in any of the plurality of work positions, wherein the control system comprises a second blocker including at least one of 1) a non-transitory computer readable medium storing program code, that when executed by the control system, cause the control system to block the rotation and/or tilting of the auxiliary tool when the excavator thumb is positioned in any of the plurality of work positions, or 2) the second blocker being configured to block the rotation and/or tilting of the auxiliary tool when the excavator thumb is positioned in any of the plurality of work positions by blocking the hydraulic fluid to the tiltrotator.

10. A control system according to claim 9, characterised in that the second blocker is arranged to block manoeuvring input from the manoeuvring device requesting rotation and/or tilting of the auxiliary tool when the excavator thumb is positioned in any of the plurality of work positions.

11. A computer implemented method for controlling an excavator, the excavator comprising a movable arm, a movable excavator thumb and a tiltrotator attached to the arm, the tiltrotator being arranged to hold an auxiliary tool which is rotatable and/or tiltable by means of the tiltrotator, the computer implemented method comprising the steps of:

receiving manoeuvring input from a manoeuvring device manoeuvred by an operator;

detecting the position of the auxiliary tool between a plurality of first positions and at least one second position; and blocking the movement of the excavator thumb when the auxiliary tool is positioned in any of the plurality of first positions.

12. The computer implemented method according to the claim 11, characterised in that the step of blocking the movement of the excavator thumb comprises blocking the manoeuvring input from the manoeuvring device requesting movement of the excavator thumb.

13. The computer implemented method according to claim 11, characterised in that the method comprises the step of blocking the rotation and/or tilting of the auxiliary tool when the excavator thumb is positioned in any of the plurality of work positions.

14. A computer implemented method for controlling an excavator, the excavator comprising a movable arm, a movable excavator thumb and a tiltrotator attached to the arm, the tiltrotator being arranged to hold an auxiliary tool which is rotatable and/or tiltable by means of the tiltrotator, the computer implemented method comprising the steps of:

receiving manoeuvring input from a manoeuvring device manoeuvred by an operator;

detecting the position of the excavator thumb between at least one rest position and a plurality of work positions; and blocking the rotation and/or tilting of the auxiliary tool when the excavator thumb is positioned in any of the plurality of work positions.

15. The computer implemented method according to claim 14, characterised in that the step of blocking the rotation and/or tilting of the auxiliary tool comprises blocking the manoeuvring input from the manoeuvring device requesting rotation and/or tilting of the auxiliary tool.

* * * * *